US007361038B2

(12) United States Patent
Duquerroy et al.

(10) Patent No.: US 7,361,038 B2
(45) Date of Patent: Apr. 22, 2008

(54) MICROSWITCH CONNECTOR

(75) Inventors: Patrick Marcel Duquerroy, Seligenstadt (DE); Sébastien Kempter, Reverolle (CH); Blaise Rithener, Vevey (CH)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 10/547,270

(22) PCT Filed: Feb. 19, 2004

(86) PCT No.: PCT/EP2004/001631

§ 371 (c)(1),
(2), (4) Date: Aug. 4, 2006

(87) PCT Pub. No.: WO2004/077626

PCT Pub. Date: Sep. 10, 2004

(65) Prior Publication Data

US 2006/0276067 A1 Dec. 7, 2006

(30) Foreign Application Priority Data

Feb. 28, 2003 (DE) ..... 203 03 526 U

(51) Int. Cl.
*H01R 29/00* (2006.01)

(52) U.S. Cl. ..... 439/188; 439/83; 439/944; 439/931; 200/51.1

(58) Field of Classification Search ..... 439/188, 439/83, 944, 931; 200/51.1
See application file for complete search history.

(56) References Cited

U.S. PATENT DOCUMENTS

| | | | | |
|---|---|---|---|---|
| 4,633,048 | A | 12/1986 | Komatsu | |
| 6,419,510 | B2 * | 7/2002 | Shiraki et al. | 439/188 |
| 6,520,785 | B2 * | 2/2003 | Hida | 439/188 |
| 6,659,784 | B1 * | 12/2003 | Klein et al. | 439/188 |
| 6,881,082 | B2 * | 4/2005 | Jordan et al. | 439/188 |
| 2002/0090863 | A1 | 7/2002 | Baumgaertner et al. | |

FOREIGN PATENT DOCUMENTS

| | | |
|---|---|---|
| EP | 0 845 838 A | 6/1998 |
| GB | 2 319 673 A | 5/1998 |
| WO | WO 02/073741 | 9/2002 |

* cited by examiner

*Primary Examiner*—Truc Nguyen
(74) *Attorney, Agent, or Firm*—Barley Snyder, LLC

(57) ABSTRACT

The invention relates to a Microswitch connector (11), having an insulating housing (13) with a contact chamber (31) with an insertion opening (15) and a contact switch spring (25) arranged in the contact chamber (31). The housing (13) has an electrically conductive stop (59) on a side of the contact chamber (31) remote from the insertion opening (15) for making a first external electrical connection. The contact switch spring (25) has a spring bend connecting a fixed leg (37) to a switch leg (39). The fixed leg (37) is fixed in the housing (13) outside the insertion path of the plug-in contact with a connection end (45) for making a second external electrical connection, and the switch leg (39) extends obliquely into the insertion path in the direction of the stop (59) and pivotal resiliently relative to the fixed leg (37) with a free end (57) pre-tensioned to rest against the stop (59).

12 Claims, 3 Drawing Sheets

MICROSWITCH CONNECTOR

FIELD OF THE INVENTION

The invention relates to a microswitch connector with a contact chamber for receiving a plug-in contact wherein, when the contact chamber is free of a plug-in contact, a movable contact arranged in the contact chamber connects with a fixed contact, and, when a plug-in contact is inserted into the contact chamber, the movable contact connects with the plug-in contact along an insertion path and the movable contact is separated from the fixed contact.

BACKGROUND

Such a microswitch connector is used, for example, as an interface switch connector in a mobile phone to connect an external aerial to the mobile phone. The switch connector has the function of connecting the send/receive circuit of the mobile phone either to the internal aerial or to the external aerial, which may be mounted in a motor vehicle, for example. A plug-in connector, connected to the external aerial, may be inserted into the microswitch connector, simultaneously disconnecting the internal aerial from the send/receive circuit and making a plug-in connection between the send/receive circuit and the external aerial. By pulling the plug-in connector out of the microswitch connector, the connection between the external aerial and the send/receive circuit is separated and the send/receive circuit is connected again to the internal aerial. Because of the increasingly small dimensions of mobile phones, such microswitch connectors must also be miniaturised accordingly.

A switch connector is known from DE 100 51 791 A1, which is designed for use in mobile phones and has a housing with a contact chamber accessible for a plug-in contact via an insertion opening. In the contact chamber there is a U-shaped spring clip between whose legs the plug-in contact is held in place when inserted into the insertion opening. When the plug-in contact is not inserted the free ends of the two legs rest against a metallic-coated and therefore electrically conductive projection of the housing. By inserting the plug-in contact the legs of the spring clips are spread so far apart that electrical contact between the two legs and the conductive projection is separated. The spring clip extends in a direction transverse to the insertion path of the plug-in contact and in this direction has a considerably larger dimension than the diameter of the insertion opening. This results in a correspondingly large dimension of the switch connector which stands in the way of increased miniaturization for mobile phones.

From U.S. Pat. No 4,633,048 a switch connector is known wherein an electrical connection is interrupted by inserting a plug-in contact into the switch connector. This switch connector has a connector housing which has an approximately cube-shaped housing portion with a cylindrical housing portion extending therefrom. In the connector housing two contacts are arranged, each having a plate-shaped contact region which is accommodated in the cube-shaped housing portion. Each also has a connecting tab projecting therefrom, and a movable resilient contact region which projects into the cylindrical housing portion. The movable resilient contact region of the one contact is provided as a flat fork while the movable resilient contact region of the other contact is provided as an insertion sleeve for the plug-in contact. The insertion sleeve is pre-tensioned in such a way that it is positioned eccentrically with reference to an insertion opening of the cylindrical housing portion as long as there is no plug-in contact inserted into the insertion sleeve. In this eccentric position the insertion sleeve is in electrical contact with the flat fork of the other contact. If a plug-in contact is inserted into the insertion sleeve, the insertion sleeve is moved into a centered position with reference to the cylindrical housing portion, the insertion sleeve being raised from the flat fork and thus the electrical connection between two contacts being interrupted. This switch connector is difficult to manufacture in dimensions which are suited to a mobile phone of small construction.

From U.S. Pat. No. 4,070,557, a plug-in connector is known with two rows of connector pins, wherein between one of the two rows and a housing wall a plate-shaped bridging contact member is arranged having two spring arms which, in a relaxed state, are in electrical contact with two of the connector pins. When a mating connector is inserted into the housing of the plug-in connector, the spring arms are pushed out of contact with the connector pins by a partition wall of the mating connector, so that the previous electrical bridging of the two connector pins is interrupted by the bridging contact member. This plug-in connector also has dimensions which render it unsuitable for use in mobile phones.

SUMMARY

The present invention provides a microswitch connector which is suitable for use in mobile phones of particularly small dimensions.

The invention relates to a Microswitch connector, having an insulating housing with a contact chamber with an insertion opening and a contact switch spring arranged in the contact chamber. The housing has an electrically conductive stop n a side of the contact chamber remote from the insertion opening for making a first external electrical connection. The contact switch spring has a spring bend connecting a fixed leg to a switch leg. The fixed leg is fixed in the housing outside the insertion path of the plug-in contact with a contact end for making a second external electrical connection, and the switch leg extends obliquely into the insertion path in the direction of the stop (59) and pivotal resiliently relative to the fixed leg with a free end pre-tensioned to rest against the stop.

BRIEF DESCRIPTION OF THE DRAWINGS

The invention is now described in more detail by reference to an exemplary embodiment. In the drawings.

DETAILED DESCRIPTION OF THE EMBODIMENT

In all the figures the microswitch connector is greatly enlarged.

Figure 1:
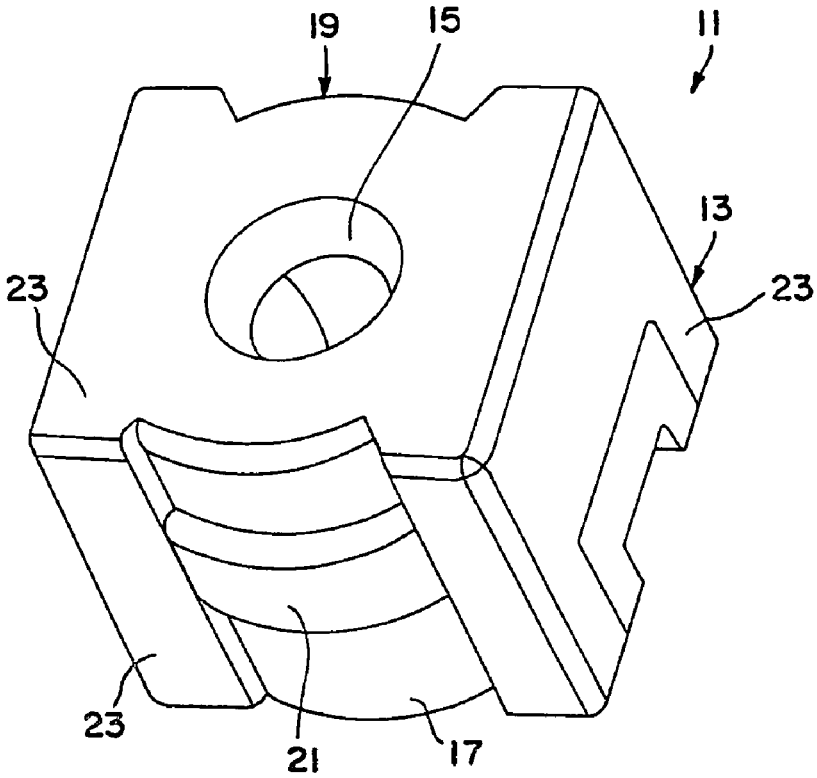
FIG. 1 shows an enlarged perspective view of a microswitch connector according to exemplary embodiment of the invention.

FIG. 1 shows a perspective view from above of a microswitch connector 11 according to an exemplary embodiment of the invention. The microswitch connector 11 comprises a housing 13 which is approximately cubic in shape with a side length of in the range of between about 2 mm to 5 mm, preferably approximately 3 mm. At the top of the housing 13 a cover wall is provided with an insertion opening 15 for the insertion of a plug-in contact (not shown). In FIG. 1 side walls 17 and 19 disposed at the front and back of the housing 13, respectively, are partially circular in shape over a central portion. At about half their height, the two side walls 17 and 19 are provided with a latching projection 21 which can cooperate with a complementary latching device of a mating plug-in connector in order to keep the two connectors latched with one another.

Figure 2:
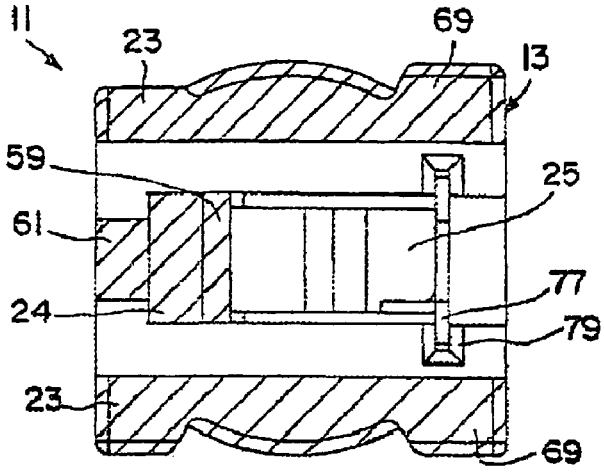
FIG. 2 shows a bottom view of the microswitch connector according to FIG. 1.
Figure 3:
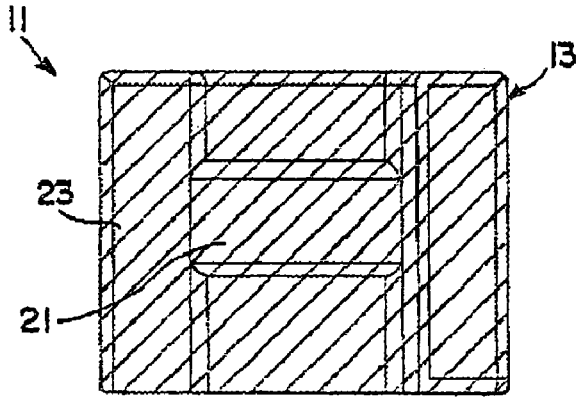
FIG. 3 shows a first side view of the microswitch connector according to FIG. 1.
Figure 4:
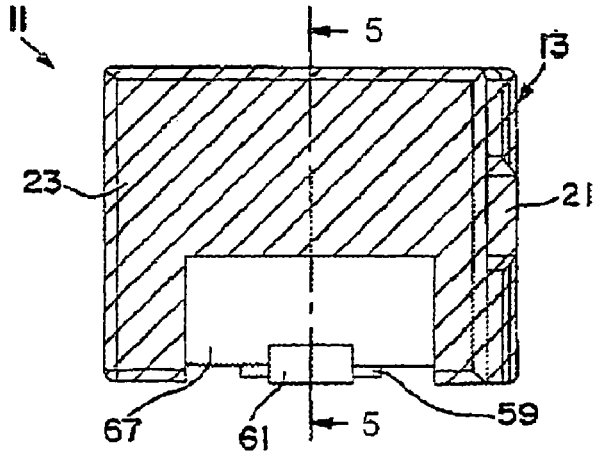
FIG. 4 shows a second side view of the microswitch connector according to FIG. 1 rotated 900 from the side view in FIG. 3.

The housing 13 is manufactured by the MID technique. This means the housing 13 is molded with two different plastics which behave differently during plating of metallic coatings applied to their surfaces. In the same plating process, the surface of the one plastic can be plated while no metal will adhere to the surface of the other plastic. Selective plating on the desired surface regions of the housing 13 can be achieved in this manner, therefore, by the selective pattern of the two plastics. In FIGS. 2-4 metallic-coated surface regions 23 are shown hatched. The purpose of this metallic coating will be explained later.

FIG. 2 shows a bottom view of the microswitch connector 11. Surface regions 23 of the housing 13 which are selectively metallically coated and therefore electrically conductive, are also shown hatched in this view. FIG. 2 also contains a bottom view of a contact switch spring 25 provided according to the invention. The significance of the metallic-coated surface regions 23 visible in FIG. 2 and details of the contact switch spring 25 are explained in more detail in connection with FIG. 5.

FIGS. 3 and 4 show side views of the microswitch connector 11 shown in FIG. 1. FIG. 3 shows a side view which corresponds to the front side wall 17 in FIG. 1. FIG. 4 shows a side view which corresponds to the right side wall, shown in FIG. 1 and the left side in FIG. 2. In FIGS. 3 and 4 selectively metallic-coated surface regions 23 are also shown hatched. FIGS. 3 and 4 show one of the latching projections 21 from the front and from the side, respectively.

Figure 5:
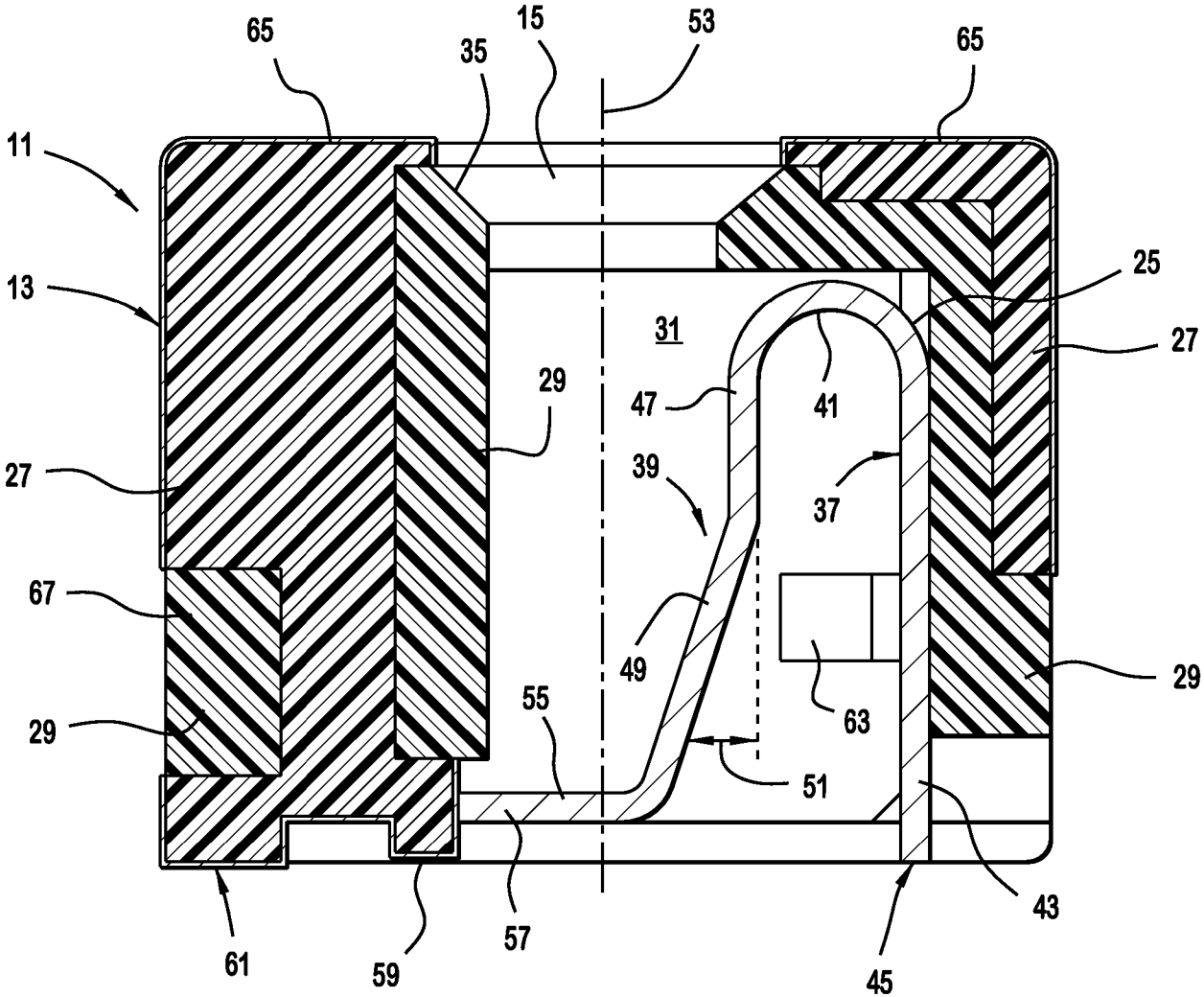
FIG. 5 shows an enlarged sectional view of the microswitch connector taken along the section line 5-5 in FIG. 4.

FIG. 5 shows a highly enlarged cross-section along the section line 5-5 of FIG. 4. Portions of the housing 13 which are constructed with a plastic 27 that is metallically coatable on its surface by plating are characterised by hatching running from top right to bottom left. Portions of the housing which are constructed with a plastic 29 whose surface is not metallically coatable by plating, are shown with the hatching running from top left to bottom right. The surface of the housing 13 is electrically conductive at the point where the plated plastic 27 is situated, while the surface of the housing 13 is electrically insulating where the non-plated plastic 29 is situated.

The housing 13 has a contact chamber 31 which at its upper end in FIG. 5 is accessible via an insertion opening 15 for the insertion of a plug-in contact that is not shown. The insertion opening 15 is chamfered at its periphery in order to form a lead-in funnel 35 which facilitates the insertion of the plug-in contact. The contact switch spring 25 is arranged in the contact chamber 31. The contact switch spring 25 is formed from a conductive material, and may, for example be stamped in one piece out of an electrically conductive metal sheet. The contact switch spring 25 has a fixed leg 37 and a switch leg 39 which are mutually connected via a spring bend 41 at the ends on the insertion opening side. The spring bend 41 is located in a region of the contact chamber which is diametrically opposed to the location of the stop 59. The fixed leg 37 and the spring bend 41 are situated outside of an insertion path defined by the insertion opening 15. Accordingly, the fixed leg 37 and spring bend 41 are located outside of the region of the contact chamber 31 which is occupied by a plug-in contact when it is inserted into the contact chamber 31. The fixed leg 37 is fixed in the housing 11, with a connection end 45 at the lower end of the fixed leg 37 extending past the adjacent portions of the housing 13 in order to allow electrical connection with a printed conductor of a printed circuit board (not shown).

The switch leg 39 has an initial region 47 connecting to the spring bend 41, which initial region 47 runs substantially parallel to the fixed leg 37 and is also situated outside the insertion path of a plug-in contact. A central region 49 of the switch leg 39 connects to the initial region 47, and extends from the initial region 47 at an angle 51 such that it protrudes obliquely downwards (shown in FIG. 5) from the initial region 47 and projects into the insertion path for the plug-in contact. The angle 51 is chosen such that the central region 49 does not extend beyond a center line 53 of the insertion opening 33, but (as shown in FIG. 5) ends at a distance to the right of the center line 53. In a practical example the angle 51 is in the region of approximately 15° to 30°, for example in the region of about 20°.

An end region 55 of the switch leg 39 is connected to the lower end of the central region 49. In the embodiment shown, the end region 55 extends in a direction perpendicular to the center line 53. A free end 57 of the end region 55 rests against a stop 59 of the housing 13 when no plug-in contact is inserted into the insertion opening 33. The stop 59 belongs to the housing region 23 with a metallic-coated surface, thus resulting in electrical contact between the switch leg 39 and the stop 59. The stop 59 is in electrical connection with a contact face 61 of the housing 13 which contact face 61 is provided for making contact with a printed conductor of a printed circuit board. Via the contact face 61 the end region 55 of the switch leg 39 is electrically connected with a printed conductor of the printed circuit board when the free end 57 of the switch leg 39 rests against the stop 59 while no plug-in contact is inserted.

As can be seen particularly well in FIG. 4, the electrically conductive stop 59 and the electrically conductive contact face 61 are electrically isolated from the conductive surface 23 of the housing 13 by means of an electrically insulative surface zone 67 of the housing 13. As best shown in FIG. 2, the stop 59 and contact face 61 are mutually electrically connected via an electrically conductive bridge 24 of the housing 13.

If a plug-in contact is inserted into the contact chamber 31 through the insertion opening 15, during the insertion procedure this plug-in contact will come into contact with the central region 49 of the switch leg 39, making an electrical contact between the plug-in contact and the contact switch spring 25. The free end 57 of the end region 55 of the switch leg 39 urged away and is electrically disconnected from the conductive stop 59, thereby breaking the electrical connection between the contact switch spring 25 and the contact face 61 of the housing 13, and thus interrupting the electrical connection between the contact switch spring 25 and the printed conductor of the printed circuit board. As long as the plug-in contact is not inserted into the contact chamber 31, or at least is not inserted far enough for it to effect movement of the switch leg 39 toward the fixed leg 37, there is an electrical connection between a first electrical component, which is connected with the connection end 45 of the fixed leg 37, and a second electrical component, which is in electrical connection with the contact face 61. As soon as a plug-in contact is inserted into the contact chamber 31 far enough such that the free end 57 of the switch leg 39 is urged away from the electrically conductive stop 59, an electrical connection is made between the first electrical component connected to the connection end 45 of the fixed leg 37 and a third electrical component connected to the plug-in contact, while the electrical connection between the first electrical component and the second electrical component is interrupted.

In a practical application, wherein such a microswitch connector 11 is used for switching between an external aerial and an internal aerial of a mobile phone, the connection end 45 of the fixed leg 37 is connected with a send/receive circuit for example, while an internal aerial is connected to the electrically conductive contact face 61. The plug-in contact insertable into the contact chamber 31 is connected to the external aerial. By inserting the plug-in contact into the contact chamber 31 a switchover is effected from operation with an internal aerial to operation with an external aerial.

Because a practical development of a microswitch connector 11 according to the invention is very small and the side dimension of the roughly cubical housing 13 is only approximately 3 mm, the contact switch spring 25 is also correspondingly small and slender. In order to protect the contact switch spring 25 from being overstretched, a limit stop 63 may be arranged on the side of the fixed leg 37 facing the switch leg 39, which limit stop 63 restricts an excessive movement of the switch leg 39 in the direction of the fixed leg 37.

In a practical application of the microswitch connector 11 according to the invention, for example switching between an internal aerial and an external aerial of a mobile phone, the microswitch connector cooperates with a coaxial plug-in contact that is connected to a coaxial cable. The internal conductor of the coaxial cable is connected to the plug-in contact which is insertable into the contact chamber 31, while an external conductor of the coaxial cable is connected to an electrically conductive sleeve coaxially surrounding the insertable plug-in contact, which sleeve in the case when the plug-in contact is fully inserted into the contact chamber 31 rests against an electrically conductive external conductor contact face 65 coaxially surrounding the insertion opening 15 at the upper surface of the housing 13 as shown in FIG. 5.

The external conductor contact face 65 is electrically isolated from the electrically conductive stop 59 and the contact face 61 of the housing 13 by means of the insulative surface zone 67 which is formed by a portion of the non-metallic-coated plastic 29. At the sides of the housing 13 on which latching projections 21 are provided, the metallic-coated region 23 of the housing 13 reaches down from the external conductor contact face 65 as far as external conductor contact faces 69, which at the underside of the housing 13 visible in FIG. 2 are formed by a surface metallic coating of the housing 13. These external conductor contact faces 69 are restricted to side regions of the housing underside situated above and below in FIG. 2, in order to secure electrical isolation with reference to an electrically conductive face at the underside of the housing 13, which face encompasses the electrically conductive stop 59 and the contact face 61.

Figure 6:
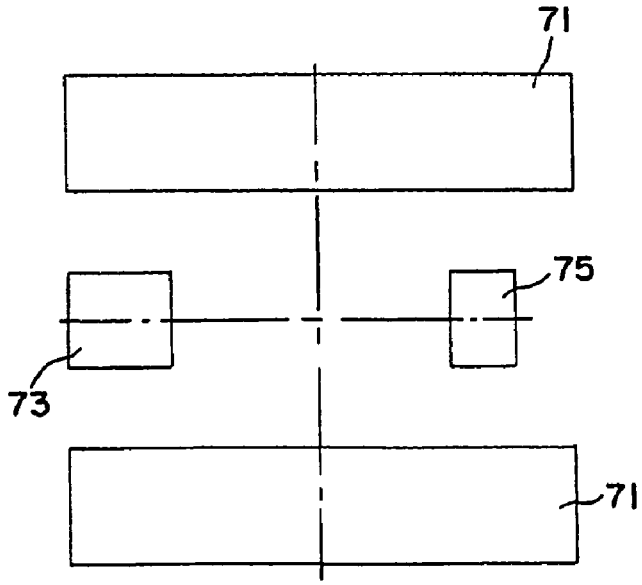
FIG. 6 shows a layout of pads on a printed circuit board suitable for mounting the microswitch connector of FIG. 1.

FIG. 6 shows a layout of a portion of a printed circuit board, the remainder of which is not illustrated, comprising a top view of contact faces of the printed circuit board which are provided for electrical connection with conductive regions at the underside of the housing 13 and with the connection end 45 of the fixed leg 37. This layout comprises two longitudinal contact strips 71 situated at the top and bottom in FIG. 6, which contact strips 71 provide electrical connection to the external conductor contact faces 69. Between the two contact strips 71 there is a contact face 73 and a further contact face 75. The contact face 73 serves to provide electrical connection with the contact face 61 of the housing 13, while the contact face 75 serves to provide electrical connection with the connection end 45 of the fixed leg 37.

Between the spring bend 41 and the connection end 45 the fixed leg 37 has a widened region 77 by means of which the fixed leg 37 can be fixed in grooves 79 of the housing 13, as can be seen on FIG. 2. For a particularly effective fixing of the fixed leg 37 in the grooves 79, the fixed leg 37 may be provided with fixing elements, for example barbs, at the two sides engaging with the grooves 79.

The contact switch spring 25 has a shape such that it can be easily stamped from an electrically conductive metal sheet. By means of the use of MID technique in the manufacture of the housing 13, a selective surface metallic coating can also be manufactured simply and inexpensively for a housing 13 with small dimensions such as are desired in a practical embodiment of the microswitch connector 11 according to the invention. The microswitch connector 11 according to the invention can therefore not only be greatly miniaturised but can also be manufactured in an inexpensive manner that is very important in the case of mass-produced goods, such as mobile phones. This applies particularly when the microswitch connector 11 is designed as a coaxial microswitch connector in a technically simple manner.

Because the contact switch spring 25 extends parallel to the insertion path and only has one leg projecting into the insertion path, the contact switch spring 25 can be manufactured with particularly small dimensions, particularly as regards the dimension transverse to the direction of insertion, so that not only a correspondingly small dimensioned housing is sufficient but in the event that a plurality of such microswitch connectors are arranged in a row there is relatively little need for space overall, which is particularly important in the case of a plugged interface for a miniaturised mobile phone.

What is claimed is:

1. A coaxial microswitch connector comprising:

an insulating housing with at least one contact chamber having an insertion opening for inserting a plug-in contact, the housing having an electrically conductive stop on a side of the at least one contact chamber remote from the insertion opening, the electrically conductive stop being an integral part of the housing and being configured for making a first external electrical connection; and a contact switch spring arranged in the at least one contact chamber, the contact switch spring having a fixed leg and a switch leg connected by a spring bend, the fixed leg being fixed in the housing outside of an insertion path of the plug-in contact and having a contact end remote from the insertion opening for making a second external electrical connection, the switch leg extending obliquely into the insertion path in the direction from the insertion opening to the electrically conductive stop and pivotal resiliently relative to the fixed leg with a free end pre-tensioned to rest against the electrically conductive stop, whereby when a plug-in contact is inserted through the insertion opening, the plug-in contact contacts the switch leg along the insertion path of the plug-in contact and urges the free end away from the electrically conductive stop;

wherein the switch leg comprises an initial region extending from the spring bend, proximate the insertion opening, parallel to the insertion path and outside the insertion path, a central region connecting with the initial region extending into the insertion path pointing away obliquely from the insertion opening, and a free end region terminating in the free end and extending to the stop.

2. The microswitch connector according to claim 1, wherein the stop and the connecting end of the fixed leg are arranged at an end of the housing opposite the insertion opening.

3. The microswitch connector according to claim 1, wherein the stop is in a region of the contact chamber which is diametrically opposed to the site of the spring bend.

4. The microswitch connector according to claim 1, wherein the end region extends transversely to the insertion path.

5. The microswitch connector according to claim 1, wherein a stop projects from the fixed leg in the direction of the switch leg, which stop limits movement of the switch leg in the direction of the fixed leg.

6. The microswitch connector according to claim 1, wherein an external side of the housing is provided with a latching device.

7. The microswitch connector according to claim 1, wherein the housing has an external height dimension and external side dimensions in the region of approximately 2 to 5 mm.

8. The microswitch connector according to claim 4, wherein the central region projects into the insertion path without crossing a center line of the insertion opening.

9. The microswitch connector according to claim 8, wherein the central region of the switch leg extends away from the initial region at an angle in the range of about 15° to 30°.

10. The microswitch connector according to claim 5, wherein the housing is provided with electrically insulating zones and with electrically conductive zones.

11. The microswitch connector according to claim 10, wherein the stop is provided by an electrically conductive zone of the housing.

12. The microswitch connector according to claim 11, wherein the housing is provided with an electrically conductive external region configured to form an electrical contact with an external conductor of a coaxial plug with the coaxial plug inserted into the microswitch connector and with a printed conductor of a printed circuit board on which the microswitch connector is mounted, the electrically conductive stop and the electrically conductive external region being electrically separated by means of an electrically insulating zone of the housing.

* * * * *